US006739833B2

(12) United States Patent
Makino et al.

(10) Patent No.: US 6,739,833 B2
(45) Date of Patent: May 25, 2004

(54) COMPRESSOR WITH BUILT-IN MOTOR, AND MOBILE STRUCTURE USING THE SAME

(75) Inventors: Masahiko Makino, Shiga (JP); Yoshifumi Abe, Ritto (JP); Tatsuhisa Taguchi, Kusatsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 195 days.

(21) Appl. No.: 10/096,418

(22) Filed: Mar. 13, 2002

(65) Prior Publication Data

US 2002/0131880 A1 Sep. 19, 2002

(30) Foreign Application Priority Data

Mar. 14, 2001 (JP) ..... 2001-071734

(51) Int. Cl.[7] ..... F04D 29/06

(52) U.S. Cl. ..... 415/174.3; 415/229; 417/410.5; 417/365; 418/55.1

(58) Field of Search ..... 415/175, 174.3, 415/174.2, 170.1, 112, 111, 229, 230; 417/410.5, 365; 418/55.1, 55.6

(56) References Cited

U.S. PATENT DOCUMENTS 6,544,009 B2 * 4/2003 Makino et al. ..... 417/312

* cited by examiner

*Primary Examiner*—Edward K. Look
*Assistant Examiner*—Kimya N. McCoy
(74) *Attorney, Agent, or Firm*—Greenblum & Bernstein, P.L.C.

(57) ABSTRACT

A compressor in which an electric motor and a compressing mechanism are accommodated in a case, a main shaft and an auxiliary shaft of a rotating shaft of the motor are supported by a radial plain bearing and a rolling bearing with a predetermined clearance given to the rotating shaft in an axial direction, a flange portion that contacts with a main-shaft receiving member of the radial plain bearing to align the rotating shaft with the compressing mechanism is provided on the main shaft, and preload toward the side of the rolling bearing is given to the rotating shaft. In this constitution, a prevention member for preventing contact and/or collision of the rotating shaft with the main-shaft receiving member is provided between opposing faces of the flange portion and the main-shaft receiving member.

12 Claims, 7 Drawing Sheets

COMPRESSOR WITH BUILT-IN MOTOR, AND MOBILE STRUCTURE USING THE SAME

The present disclosure relates to subject matter contained in priority Japanese Patent Application No. 2001-71734, filed on Mar. 14, 2001, the contents of which is herein expressly incorporated by reference in its entirety.

BACKGROUND OF THE INVENTION

1. Field of the Invention

The present invention relates to a compressor with a built-in electric motor suitable for mounting on a mobile structure such as an electric vehicle or a hybrid vehicle, and is used with a battery. The invention also relates to a mobile structure having such a compressor.

2. Description of Related Art

In a vehicle driven only by an engine, a compressor driven by the engine has been used for air-conditioning the vehicle compartment with the compressor being mounted alongside of the engine.

Electric vehicles and hybrid vehicles having both an engine and an electric motor and traveling by use of one of them according to conditions have been practically used for going on public roads. Between the two kinds of vehicles, most of those going on public roads are the hybrid vehicles, and air-conditioning of the vehicle compartment is made by a refrigerating compressor driven by the engine in the same manner as conventional engine-driven vehicles.

It is proposed that the engines of hybrid vehicles should be shut off while they are temporarily stationary at a place such as a traffic light in order to reduce effects of the engine upon the environment. When the proposal is followed with a vehicle where a compressor driven by the engine is used, air-conditioning stops each time when the vehicle stops, causing problem for the driver and passengers in the compartment in summer and winter seasons, and especially in regions with extremely cold or hot climate.

Consequently, an idea of adopting for a compressor driven by an electric motor is conceived. Further, it is natural that, in an electric vehicle, a compressor driven by an electric motor is adopted for conducting air-conditioning. Compressors driven by electric motors include maintenance-free compressors integral with electric motors used for air-conditioning of houses, and it is preferable if such compressors can be used for electric vehicles.

The present inventors made various examinations and studies for finding possibility to use a compressor integral with an electric motor originally designed for air conditioning indoors for electric vehicles or hybrid vehicles. The result showed that a rotating shaft of an electric motor became unstable in position in an axial direction, which caused strong contact, friction, and collision between opposing faces of the rotating shaft and a main-shaft receiving member that receives a main shaft of the rotating shaft, revealing the existence of problems with respect to durability. This is because a compressor for indoor air-conditioning is stored within an outdoor unit and fixedly installed with no consideration made for motions as well as shocks applied from the outside. Vehicles often make sudden start, stop, abrupt acceleration and deceleration, and sharp cornering at high speeds. Also, large inertia force much larger than the magnitude of a preload that is given to the rotating shaft is sometimes applied to the rotating shaft and a rotor of the electric motor unitized with the rotating shaft. When such inertia force acts in the direction opposite to that of the preload, the rotating shaft moves, instantaneously and with large force, together with the rotor toward the main-shaft receiving member, causing strong collision between the opposing faces of the shaft and the receiving member. Also, the opposing faces frequently contact with each other and rub against each other.

SUMMARY OF THE INVENTION

An object of the present invention is to provide a compressor with a built-in electric motor, which is constituted such that a rotating shaft of the electric motor of the compressor is made to be stable in an axial direction so as not to cause strong friction and collision between opposing faces of a flange portion of the rotating shaft and a main-shaft receiving member. It is also an object of the invention to provide a mobile structure using the compressor described above.

In order to achieve the above objects, a compressor with a built-in electric motor according to the invention includes an electric motor and a compressing mechanism which is connected to and driven by a rotating shaft of the electric motor, and they are accommodated in a case. In this compressor, a main shaft on the side of the compressing mechanism of the rotating shaft and an auxiliary shaft at the side opposite to the main shaft of the rotating shaft are supported by a radial plain bearing and a rolling bearing so that a predetermined clearance in an axial direction is given to the rotating shaft, a flange portion for aligning the rotating shaft with the compressing mechanism through the contact of the main shaft with a main-shaft receiving member that supports the radial plain bearing, and the rotating shaft is given with preload toward the rolling bearing. The compressor is provided with a prevention member between opposing faces of the flange portion and main-shaft receiving member in order to prevent contact and/or collision of the rotating shaft with the main-shaft receiving member.

As described above, the prevention member is located between the opposing faces of the flange portion of the rotating shaft and the main-shaft receiving member. Consequently, this constitution does not prevent necessary clearance from being provided between the opposing faces, and does not prevent preload toward the rolling bearing from being given to the rotating shaft. Conventional operating performance is therefore guaranteed. When the opposing faces are about to strongly contact with each other to cause friction and collision between them because of large force such as inertia force acting in the direction opposite to that of the preload, such force is prevented by the prevention member between the opposing faces from acting. Thus, the opposing faces do not strongly contact with each other to cause friction and collision between them, so that the deterioration in performance and durability of the compressor is prevented.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF THE PREFERRED EMBODIMENTS

For better understanding the invention, a compressor with a built-in electric motor according to an embodiment of the invention will be described referring to the figures.

Figure 1:
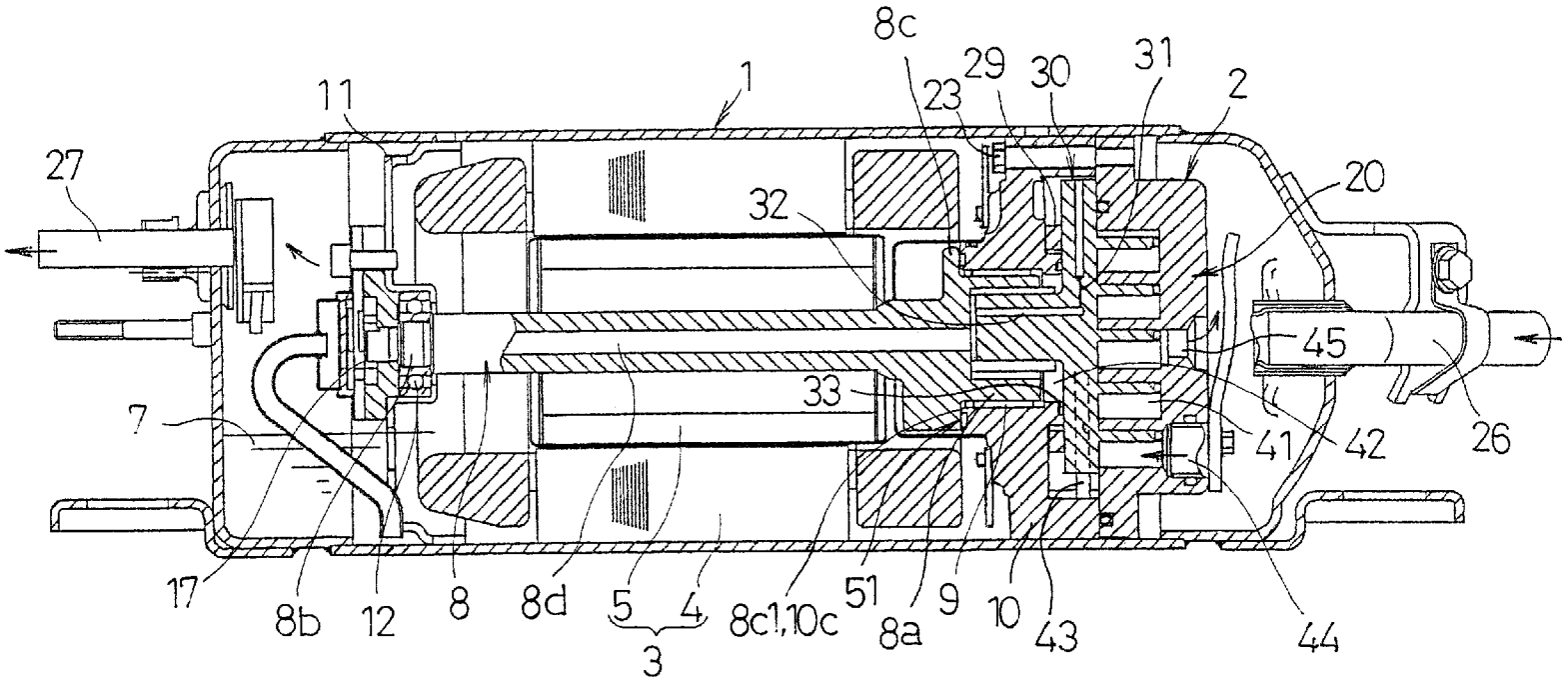
FIG. 1 is a cross-sectional view of a compressor with a built-in electric motor according to an embodiment of the invention.

A compressor with a built-in electric motor will now be described below referring to FIG. 1. An electric motor 3 and a compressing mechanism 2 that is connected to and driven by a rotating shaft 8 of the electric motor 3 are accommodated in a case 1. A main shaft 8*a* on the side of the compressing mechanism 2 of the rotating shaft 8 and an auxiliary shaft 8*b* located at the side opposite to the main shaft 8*a* of the rotating shaft 8 are supported by a radial plain bearing 9 and a rolling bearing 12 so that a predetermined clearance in an axial direction is given to the rotating shaft 8. A flange portion 8*c* is provided on the main shaft 8*a*, the flange portion for aligning the rotating shaft 8 with the compressing mechanism 2, through the contact of the shaft with a main-shaft receiving member 10 that supports the radial plain bearing 9. It is also arranged such that magnetic preload toward the side of the rolling bearing 12 is given to the rotating shaft 8 through displacement in the axial direction between a stator 4 and rotor 5 of the electric motor 3 as shown in FIG. 1. This preload enables the rotating shaft 8 to smoothly rotate and drive the compressing mechanism 2 without play yet keeping allowance for movement under the clearance in the axial direction. Further, the alignment described above is made when assembling the compressor mechanism 2 with the main-shaft receiving member 10 before they are accommodated in the case 1. Specifically, positional relationship between the rotating shaft 8 and the main-shaft receiving member 10 is first defined through the contact of opposing faces 8*c*1 and 10*c* of the flange portion 8*c* and the main-shaft receiving member 10, and then the alignment is made for correct positional relationship between the rotating shaft 8 and the compressing mechanism 2, with the main-shaft receiving member 10 set as the positioning reference member.

In the compressor with a built-in electric motor shown in FIG. 1, the rolling bearing 12 is held at an auxiliary-shaft receiving member 11 fixed to the inside of the case 1 by welding or other means.

The compressing mechanism 2 is a scroll type, and has a compression chamber 41 formed between a stationary scroll member 20 and an orbiting scroll member 30 meshed with each other. The orbiting scroll member 30 is set between the main-shaft receiving member 10 fixed to the inside of the case 1 by shrink fitting or welding and the stationary scroll member 20 fixed with bolts 23 to the main-shaft receiving member 10, and is connected to the main shaft 8*a* of the rotating shaft 8. The orbiting scroll member 30 orbits due to the rotation of the rotating shaft 8 of the motor 3 under rotation preventive effect of a rotation prevention mechanism 29 provided between the members 10 and 30. The stationary scroll member 20 is bolted to the main-shaft receiving member 10 after aligning the rotating shaft 8 with the compressing mechanism 2. As the orbiting scroll member 30 orbits, the compression chamber 41 moves from the outer periphery of the stationary scroll member 20 toward its center and diminishes the volume. In this process, the compression chamber 41 repeats the cycle consisting of the taking in of a refrigerant through an intake pipe 26 and an intake port 44, the compression of the refrigerant, and the discharge of it from a discharge port 45 into the case 1. The refrigerant discharged into the case 1 cools down the electric motor 3 before being discharged from a discharge pipe 27. The refrigerant is then supplied to a refrigerating cycle.

A pump 17 is provided at the auxiliary shaft 8*b* of the rotating shaft 8, and the pump sends oil 7 stored in the lower part of the case 1 to an oil feed passage 8*d* within the rotating shaft 8. The oil 7 is then fed through the rotating shaft 8 for the lubrication of portions including the radial plain bearing 9 at the main-shaft receiving member 10 and sliding portions of the compressing mechanism 2. The oil 7 after the lubrication gradually flows out as it seeps from the lubrication portions by the effect of oil supply pressure, and returns to the inside of the case 1. A portion of the refrigerant discharged into the case 1 accompanies the oil 7 because of its compatibility with the oil, and it lubricates areas including the rolling bearing 12 where the oil 7 is not fed by the pump 17.

Further, the oil 7 supplied to the sliding portions of the compressing mechanism 2 through the oil feed passage 8*d* of the rotating shaft 8 reaches a rear-center portion of the orbiting scroll member 30. There, the oil 7 is accumulated in a high pressure portion 42 while keeping a pressure higher than a discharge pressure of the compressing mechanism 2. The oil 7 in the high pressure portion 42 is then lead to an outer peripheral portion at the rear face of the orbiting scroll member 30 through an oil passage 32 having a pressure reduction orifice 31 provided inside the orbiting scroll member 30. Then, the oil 7 is made to accumulate in a low pressure portion 43 at a pressure lower than the discharge pressure. The high pressure portion 42 and the low pressure portion 43 are divided by a seal 33 of a circular shape between the rear face of the orbiting scroll member 30 and the main-shaft receiving member 10. The oil 7 in the low pressure portion 43 acts as back pressure to an outer periphery portion of the orbiting scroll member 30, preventing the orbiting scroll member 30 from being removed from the stationary scroll member 20 and toppled by pressure of the compressed refrigerant. A pressure adjustment valve (not shown) is provided between the low pressure portion 43 and an intake chamber of the compressing mechanism 2. The pressure adjustment valve works such that, each time when the oil 7 supplied from the high pressure portion 42 increases in volume to reach a predetermined pressure or a pressure higher than that, the valve releases the oil 7 to the intake chamber side so that a predetermined back pressure is maintained. When the increased pressure is released toward the intake chamber side, the oil 7 entering the intake chamber is used for lubricating the sliding portions of the compressing mechanism 2.

In case of a mobile structure such as an electric vehicle or a hybrid vehicle on which the compressor with a built-in electric motor as described above is mounted, when inertia force that may move the rotating shaft 8 along with the rotor 5 to the side of the main-shaft receiving member 10 acts on the compressor, the flange portion 8*c* of the rotating shaft 8 and the main-shaft receiving member 10 strongly contact with each other to cause friction and collision between them, resulting in deterioration of durability of the compressor. In a vehicle where a compressor is mounted with the axis of the main shaft being arranged in a horizontal position, the inertia force described above tends to occur when the vehicle makes sudden start and stop, and rapid acceleration and deceleration or when it turns a corner at high speed. In a vehicle where a compressor is mounted with the axis of the main shaft being arranged in an upright position, such inertia force tends to occur when it travels on a bumpy road or traveling up or down a steep gradient at high speed. It should be noted that preload for the rotating shaft 8 of a compressor mounted in an upright position can be given with the self weight of the rotating shaft 8 and rotor 5.

In order to solve the problem related to inertia force described above, the compressor according to the embodiment is provided with a prevention member 51 between the opposing faces 8*c*1 and 10*c* of the flange portion 8*c* and the main-shaft receiving member 10 for preventing the rotating shaft 8 from contacting and/or colliding with the main-shaft receiving member 10. The prevention member 51 is located between the opposing faces 8*c*1 and 10*c* of the flange portion 8*c* of the rotating shaft 8 and the main-shaft receiving member 10, does not prevent clearance from being provided between the opposing faces, and also does not prevent preload toward the side of the rolling bearing 12 from being given to the rotating shaft 8. Conventionally available operation performance of a compressor is therefore guaranteed. Even when large movement force caused by force such as inertia force acts on the rotating shaft 8 in a direction opposite to the direction of the preload to be prone to make the opposing faces 8*c*1 and 10*c* strongly rub against each other or collide with each other, such force acts on the prevention member 51 and is prevented thereby, the opposing faces 8*c*1 and 10*c* do not strongly rub against each other or collide with each other, and thus deterioration in performance and durability of the compressor is prevented.

Figure 2:
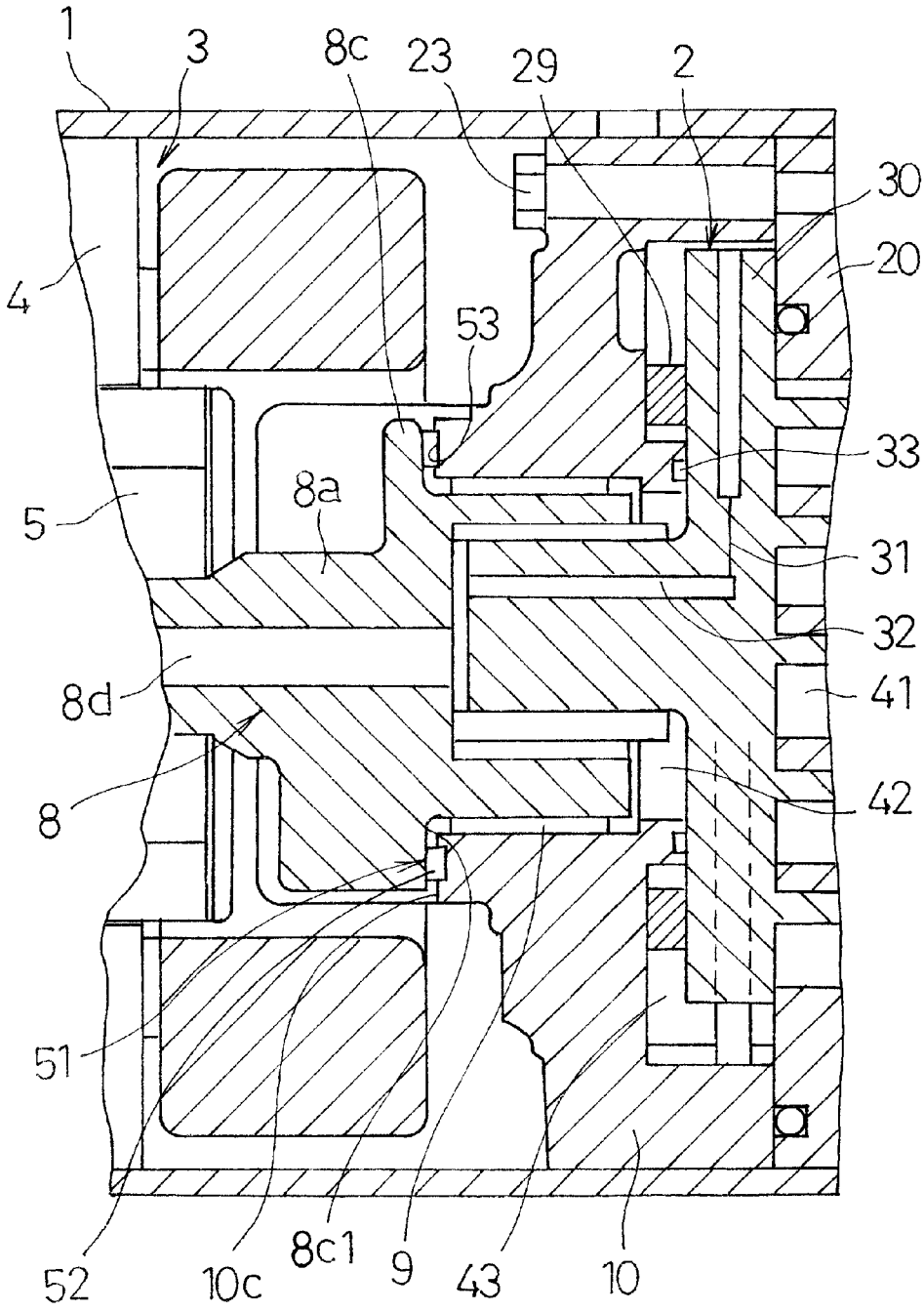
FIG. 2 is a cross-sectional view of opposing faces of a flange portion of a rotating shaft and a main-shaft receiving member of the compressor of FIG. 1.
Figure 3:
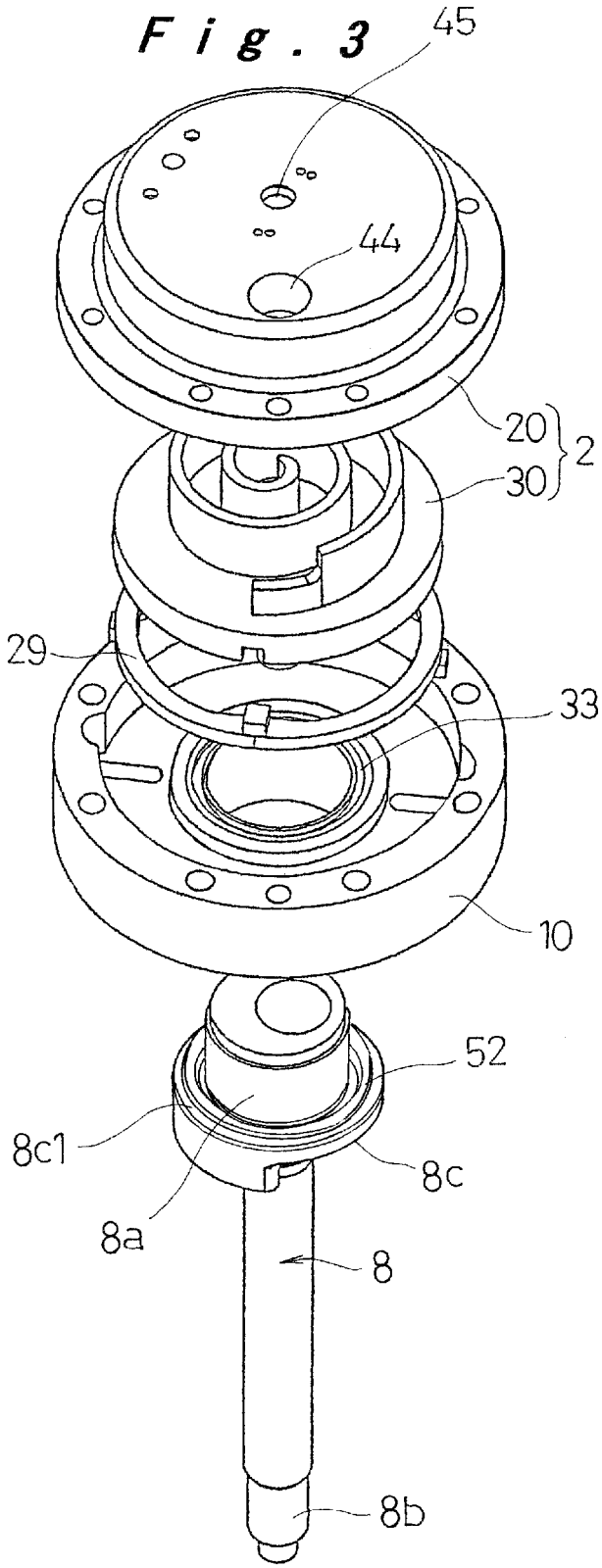
FIG. 3 is a perspective exploded view of a rotating shaft and of a compressing mechanism main unit including a main-shaft receiving member of the compressor of FIG. 1.

In the embodiment shown in FIGS. 1 to 3, the prevention member 51 is a bearing plate 52. The bearing plate 52 has a bearing face with a plane face. Because of a small relative rotation speed between the opposing faces 8*c*1, 10*c* and the bearing plate 52 working in cooperation with reduced friction due to sliding capability of the bearing face against the opposing faces 8*c*1 and 10*c*, strong contact that may cause friction and collision between the opposing faces 8*c*1 and 10*c* is prevented. The bearing plate 52 may be made of synthetic resin, metal or ceramic having excellent sliding properties. However, a material preferred is one having durability, which is a function required for maintenance-free characteristics. The bearing plate 52 is stored in a groove 53 provided at the main-shaft receiving member 10 so as not to be displaced from position. The groove 53 may be provided on the side of the flange portion 8*c*.

The oil 7 that seeps out after lubricating the radial plain bearing 9 is fed to air gap between the opposing faces 8*c*1, 10*c* and the bearing plate 52 to lubricate them. The fed oil 7 further functions as a cushion between the opposing faces 8*c*1 and 10*c*. This further eases mitigation of strong contact that causes friction and collision between the opposing faces. Further, because the groove 53 helps to accumulate the fed oil 7, the groove 53 is advantageous to improve load bearing and cushioning functions.

Figure 4:
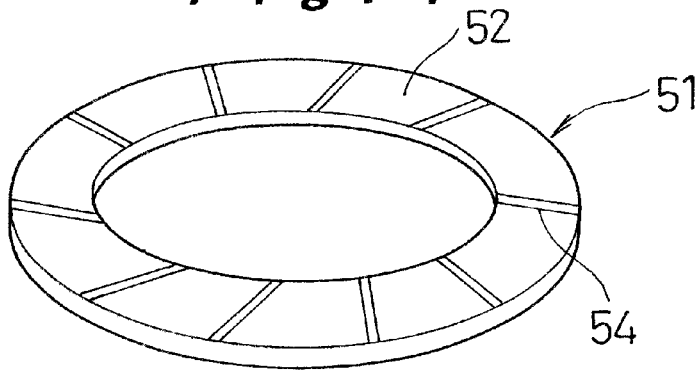
FIG. 4 is a perspective view of an example of a bearing plate where lubricating grooves are provided.

The embodiment of FIG. 4 has lubricating grooves 54 formed on the bearing plate 52, or more specifically, on the bearing surface facing the face 8*c*1 of the flange portion 8*c*. With this constitution, the oil 7 is led into between the bearing plate 52 and the face 8*c*1 which has no grooves to enhance bearing function at that place as well as cushioning function by the oil 7. However, the lubricating grooves 54 may be provided on the bearing surface facing the face 10*c* of the main-shaft receiving member 10. The lubricating grooves 54 may be provided in a circular form. However, when the grooves are formed in radial directions extending from the inner periphery of the bearing plate 52 toward the outer periphery as shown in FIG. 4, the oil 7 is more easily led to between the bearing face and the opposing face 8*c*1 or 10*c*. Further, such grooves in radial directions may be combined with a groove of a circular form. When the lubricating grooves 54 extending in radial directions from the inner periphery of the bearing plate 52 toward its outer periphery along lines passing through the center of the bearing plate 52 are formed such that each of the grooves is displaced toward a rotation direction of the flange portion 8*c* as it extends, the grooves are in an inclined or curved form as shown in FIG. 4. In this constitution, the rotation of the flange portion 8*c* provides a pump function for feeding the oil 7, led into the grooves 54, from the inside of the bearing plate 52 toward the outside. This makes the flow of the oil 7 smooth and improves the lubrication function between the face 8*c*1 and the bearing face. Further, when outer sides of the grooves 54 are narrowed or closed under such pumping function, the flow of the oil 7 sent toward the outer sides are limited or blocked, and oil pressure and the amount of the oil between the face 8*c*1 and the bearing face are increased, enhancing both lubrication characteristics and cushioning effect.

Figure 5:
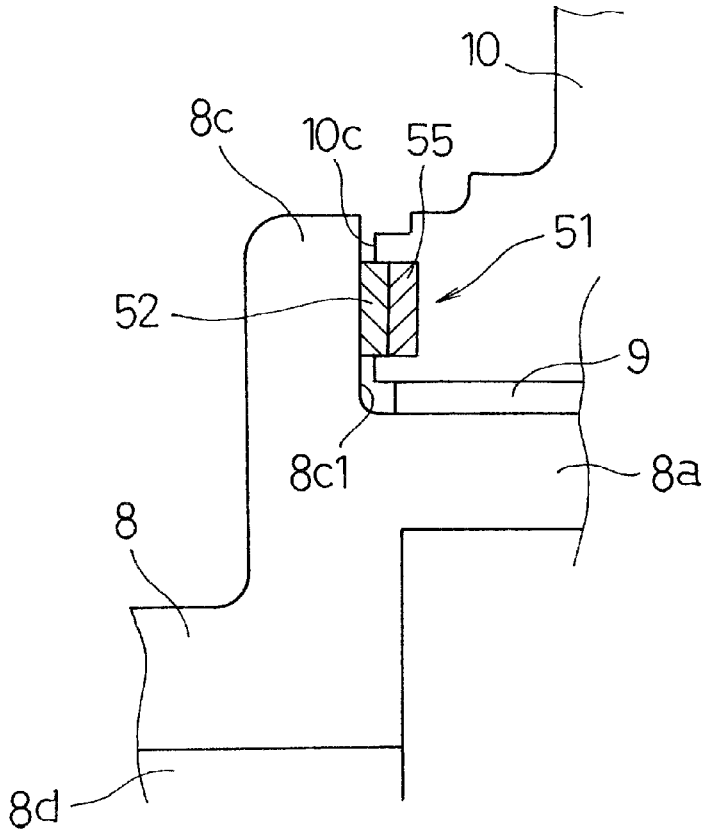
FIG. 5 is a cross-sectional view showing an example where the bearing plate of FIGS. 1 to 3 is combined with a flat ring.
Figure 6:
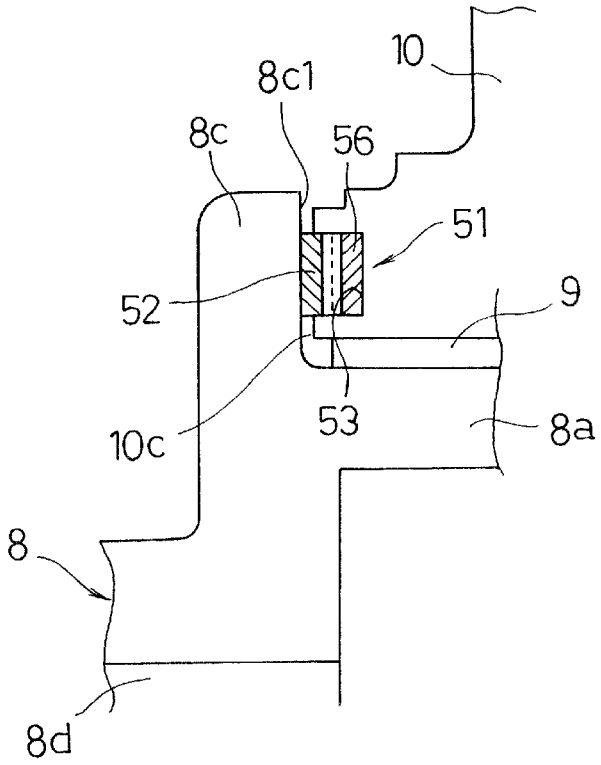
FIG. 6 is a cross-sectional view showing an example where the bearing plate of FIGS. 1 to 3 is combined with a corrugated ring.
Figure 7:
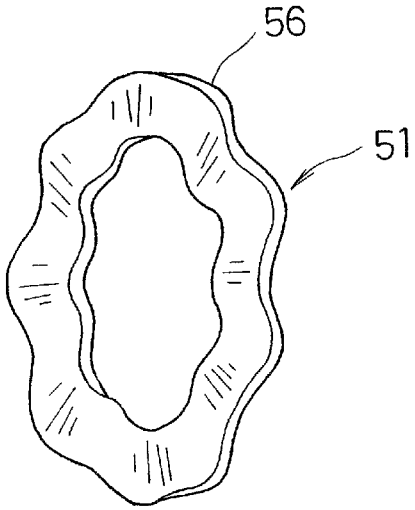
FIG. 7 is a perspective view of the corrugated ring of FIG. 6.

The embodiment of FIG. 5 and the prevention member 51 of FIGS. 6 and 7 include, in addition to the bearing plate 52, elastic members 55 and 56 that can be elastically compressed in an axial direction. In this case, when the opposing faces 8*c*1 and 10*c* are about to contact and collide with each other with the bearing plate 52 interposed therebetween the elastic members 55 or 56 eases such motion as it elastically deforms in an axial direction. Accordingly, friction and collision between the elements are more effectively eased than in the case when the bearing plate 52 alone is used. The elastic member 55 in FIG. 5 is a flat ring made of elastic material such as rubber or synthetic resin, and the elastic member 56 shown in FIGS. 6 and 7 is a corrugated plate ring made of metal. The elastic members 55 and 56 may be set in position within the clearance between the opposing faces 8*c*1 and 10*c* or may be set in position leaving a part or the whole of the clearance.

Figure 8:
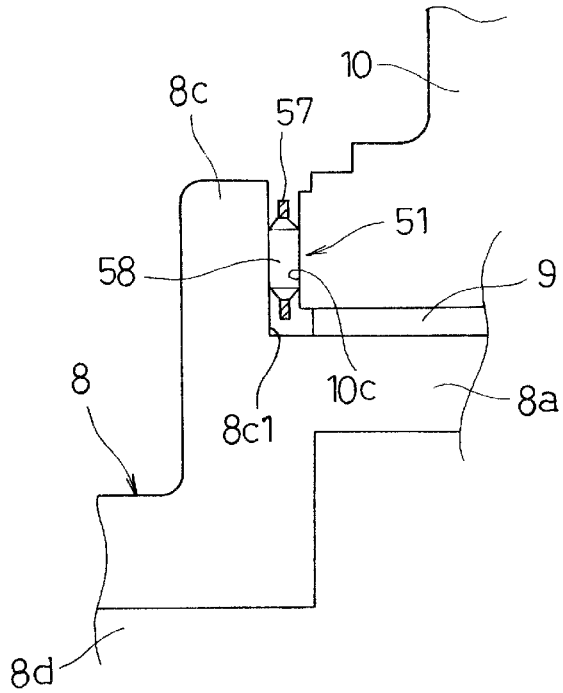
FIG. 8 is a cross-sectional view of an example where a bearing ring is provided.

The prevention member 51 of FIG. 8 is a bearing ring 57 having projections and depressions for sliding, or a rolling member 58 that provide bearing functions other than those that can be provided by a plain face. With this arrangement, bearing function between the opposing faces 8*c*1 and 10*c* is improved, further preventing friction and collision between them.

Figure 9:
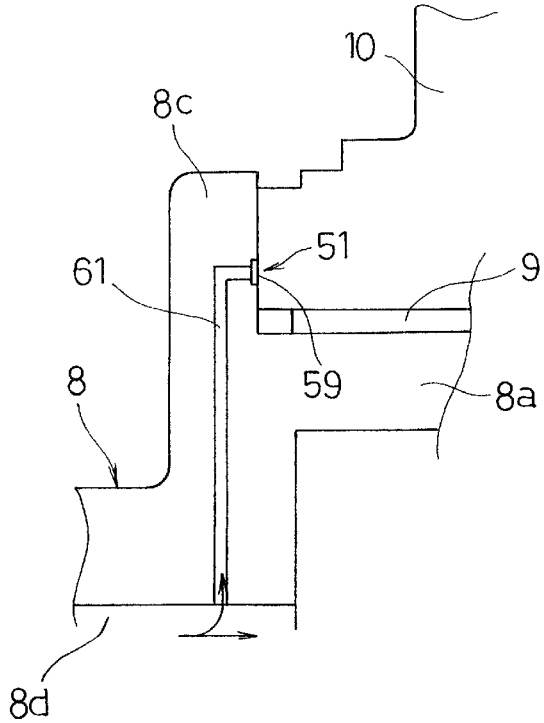
FIG. 9 is a cross-sectional view of an example where a lubricating groove is provided instead of the bearing plate of FIGS. 1 to 3 or the bearing ring of FIG. 8.
Figure 10:
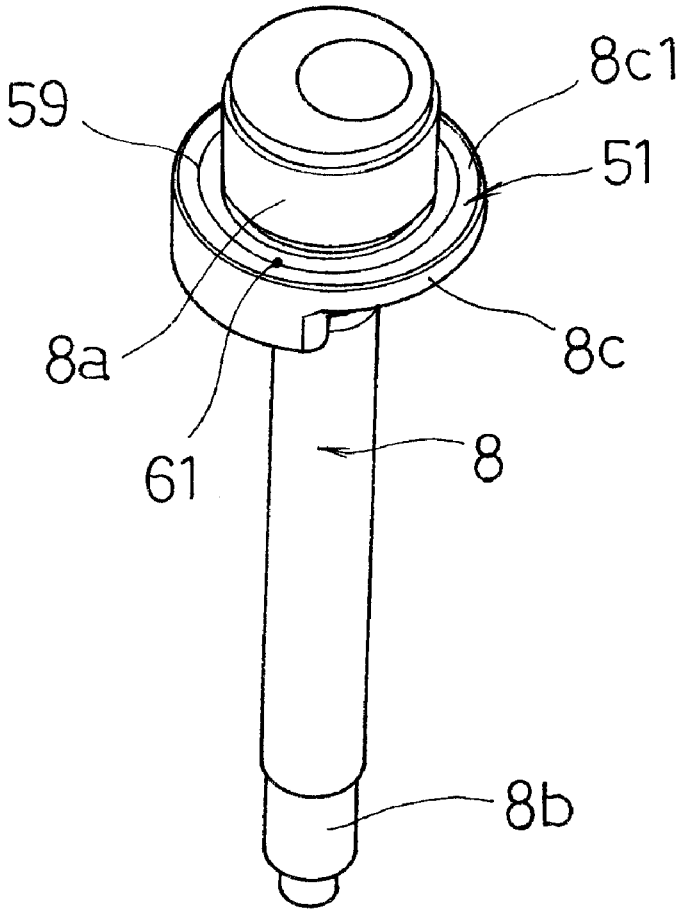
FIG. 10 is a perspective view of a rotating shaft having the lubricating groove of FIG. 9.

The prevention member 51 in the embodiment shown in FIGS. 9 and 10 is a lubricating groove 59 formed at one of the opposing faces 8*c*1 and 10*c*, or, for example, at the face

8*c*1 of the flange portion 8*c*. With this arrangement as well, the oil 7 is let into between the opposing faces 8*c*1 and 10*c*, so that bearing function between the opposing faces 8*c*1 and 10*c* is increased. Also, because of cushioning effect of the oil 7 led into the air gap between the opposing faces 8*c*1 and 10*c*, friction and collision between them are prevented from occurring.

The lubricating groove 59 is preferably connected to a position toward the inner periphery side of the flange portion 8*c* in order to let the oil 7 into the opposing faces 8*c*1 and 10*c*. However, because the prevention member 51 of this embodiment includes an oil feed passage 61 for forcibly feeding the oil 7 to the lubricating groove 59, the groove 59 is made in a circular form so that the oil 7 fed to the groove 59 is difficult to escape toward the outer periphery side. Thus the pressure and amount of the oil are increased, enhancing bearing function and cushioning effect between the opposing faces 8*c*1 and 10*c*. The groove 59 in a circular form may be arranged as a plurality of coaxial circular grooves. The oil feed passage 61 runs from the oil supply passage 8*d* of the rotating shaft 8 through the inside of the flange portion 8*c* to the lubricating groove 59. The oil feed passage 61 can supply the oil 7 even when the lubricating groove 59 is provided on the face 10*c* of the main-shaft receiving member 10.

As may be clearly understood from the description above, the prevention member according to the invention is located between the opposing faces of the flange portion of the rotating shaft and main-shaft receiving member, and does not prevent required clearance from being provided between the opposing faces, and also does not prevent preload toward the rolling bearing side from being given to the rotating shaft. Thus, conventional operation performance of a compressor is guaranteed, and even if large movement force caused by inertia force or other effects acts in a direction opposite to the preload, such force acts on the prevention member and is blocked there. Therefore, strong friction and collision between the opposing faces are prevented from occurring, thereby preventing the deterioration of performance and durability of the compressor.

Accordingly, the compressor with a built-in electric motor according to the invention is especially effective when it is mounted on electric vehicles or hybrid vehicles to which such movement force is likely to occur owing to inertia force. Also, it is preferably used as a compressor with a built-in motor that is used with a battery, as a power source, moving with some means for movement. Further, the compressor is also effective for applications other than air-conditioning.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A compressor comprising:

a motor having a rotating shaft;

a compressing mechanism connected to and driven by the rotating shaft of the motor; and a case for accommodating the motor and the compressing mechanism, the rotating shaft including a main shaft on a compressing mechanism side of the rotating shaft and an auxiliary shaft on a side opposite to the main shaft which are supported by a radial plain bearing and a rolling bearing so that a predetermined clearance in an axial direction is given to the rotating shaft, the main shaft being provided with a flange portion that contacts with a main-shaft receiving member for holding the radial plain bearing for aligning the main shaft with the compressing mechanism, preload toward the rolling bearing being given to the rotating shaft, the compressor being further provided with a prevention member between opposing faces of the flange portion and the main-shaft receiving member, the prevention member for preventing contact and/or collision of the rotating shaft with the main-shaft receiving member.

2. The compressor according to claim 1, wherein the prevention member is a bearing plate.

3. The compressor according to claim 2, wherein a lubricating groove is formed at least either on the face of the flange portion or on a face of the bearing plate.

4. The compressor according to claim 2, wherein the prevention member further includes an elastic member elastically deforming in an axial direction.

5. The compressor according to claim 4, wherein the elastic member is a flat ring made of material such as rubber or synthetic resin.

6. The compressor according to claim 4, wherein the elastic member is a corrugated plate ring made of metal.

7. The compressor according to claim 1, wherein the prevention member is a bearing ring.

8. The compressor according to claim 4, wherein the prevention member further includes an elastic member elastically deforming in an axial direction.

9. The compressor according to claim 1, wherein the prevention member is a lubricating groove formed at least on one of the opposing faces.

10. The compressor according to claim 9, wherein the prevention member includes an oil feed passage for forced feeding of oil to the lubricating groove.

11. The compressor according to claim 1, wherein the compressor is used with a battery that moves by a device for movement.

12. A mobile structure mounted with the compressor according to claim 1 along with a battery.

* * * * *